US006056648A

United States Patent [19]

Kusumoto et al.

[11] Patent Number: 6,056,648

[45] Date of Patent: May 2, 2000

[54] GOLF CLUB SHAFT

[75] Inventors: Harunobu Kusumoto, Saitama; Atsushi Matsuo, Tokyo, both of Japan

[73] Assignee: Daiwa Seiko, Inc., Tokyo, Japan

[21] Appl. No.: 08/880,066

[22] Filed: Jun. 20, 1997

[30] Foreign Application Priority Data

Jun. 20, 1996 [JP] Japan ..... 8-159728
Aug. 2, 1996 [JP] Japan ..... 8-204820

[51] Int. Cl.[7] ..... A63B 53/10

[52] U.S. Cl. ..... 473/319; 473/323; 273/DIG. 23; 273/DIG. 7

[58] Field of Search ..... 473/316–323; 273/DIG. 7, DIG. 23

[56] References Cited

U.S. PATENT DOCUMENTS

| | | | |
|---|---|---|---|
| 3,519,270 | 7/1970 | Baymiller | 473/313 |
| 4,563,007 | 1/1986 | Bayliss | 473/323 |
| 5,265,872 | 11/1993 | Tennent | 473/320 |
| 5,421,573 | 6/1995 | Kawamatsu | 473/319 |
| 5,620,380 | 4/1997 | Tennent | 473/319 |
| 5,681,226 | 10/1997 | Chambers | 473/316 |
| 5,685,783 | 11/1997 | Akatsuka | 473/319 |

FOREIGN PATENT DOCUMENTS 256049 8/1926 United Kingdom .

OTHER PUBLICATIONS

"Power–Kick Shaft" advertisement on p. 43 in Golf Digest, Mar. 1978.

*Primary Examiner*—Jeanette Chapman
*Assistant Examiner*—Stephen L. Blau
*Attorney, Agent, or Firm*—Liniak, Berenato, Longacre & White

[57] ABSTRACT

The present invention relates to a golf club shaft which is easy to be gripped, and superior in strength and balance in its shaft portion. A golf club shaft is constituted by fiber-reinforced prepreg formed from reinforcing fibers impregnated with synthetic resin. A small-diameter portion is provided on a head side, a large-diameter portion is provided on a grip side, and a tapered portion is provided between the small-diameter portion and the large-diameter portion. An outer diameter of the small-diameter portion at its rear end portion is made smaller by 2 mm or more than an outer diameter of the large-diameter portion at its front end portion, and bending rigidity at the rear end portion is made to be 60 to 100% of that at the front end portion.

7 Claims, 8 Drawing Sheets

GOLF CLUB SHAFT

BACKGROUND OF THE INVENTION

The present invention relates to a golf club shaft.

A conventional golf shaft is designed so that its torsional rigidity or bending rigidity is distributed to gradually increase as a position goes from a shaft front end portion toward a shaft grip portion, and takes the maximum in a shaft end portion on the grip side (a rear end portion of a grip portion). For example, Japanese Patent Unexamined Publication No. Hei-5-337223 discloses a golf club shaft in which the ratio (Ta:Tb) of torsional rigidity (Ta) in the rear end portion of the grip portion to torsional rigidity (Tb) in the shaft front end portion is defined so as to fall in a range of from 1:1 to 4:1.

In the above-mentioned golf club shaft, however, a question is simply put merely on the torsional rigidity (Ta) in the rear end portion of the grip portion and the torsional rigidity (Tb) in the shaft front end portion, while the total torsional rigidity of the shaft is not taken into consideration. It is therefore impossible to satisfy user's various requests in points such as handling performance, handling stability, directional stability, soft hitting sense, etc.

The characteristic required also for a golf club shaft is that the golf club shaft is light in weight so as to swing out easily, while the flying distance can be increased. To satisfy this request, it has been advanced to study a golf club shaft using fiber-reinforced prepreg. Particularly, in order to extend the flying distance, it has been studied to make the flexibility larger on the head side of the shaft than on the grip side.

A golf club shaft which can extend the flying distance is disclosed in Japanese Patent Post-Examination No. Sho-60-40309. In this golf club shaft, a small-diameter portion is provided in a head-side half of the whole length of the shaft so that a kick point which determines the behavior of the shaft appears in this small-diameter portion. Thus, the flexibility can be increased, and the flying distance can be extended.

However, since the small-diameter portion is provided in the head-side half of the whole length of the shaft in the golf club shaft, most part of the shaft is thick. Accordingly, there is a disadvantage that it is difficult to swing out sharply. In addition, only portion near the head side from the small-diameter portion is bent easily in the shaft, so that there is another disadvantage that it is easily broken at the small-diameter portion.

SUMMARY OF THE INVENTION

Taking the foregoing problems into consideration, an object of the present invention is to provide a golf club shaft having characteristics which can satisfy user's various requests.

As a result of deep consideration upon the distribution of torsional rigidity or bending rigidity in a shaft as a whole, the present inventors found that the optimum distribution of torsional rigidity or bending rigidity exists in various characteristics, and the inventors achieved the present invention.

That is, according to a first aspect of the present invention, provided is a golf club shaft using a tube body made by winding fiber-reinforced prepreg formed from reinforcing fibers impregnated with synthetic resin, wherein the tube body has a front end portion to which a club head is to be attached, a grip portion provided on the side opposite to the front end portion, and a torsional rigidity sudden-change portion provided on the side located between the front end portion and the grip portion, wherein torsional rigidity on the front end portion side in the torsional rigidity sudden-change portion is in a range of from 1 to 4 when torsional rigidity in the front end portion is assumed to be 1, wherein the maximum torsional rigidity in the grip portion is not smaller than 4.5 when torsional rigidity on the front end portion is assumed to be 1, and wherein the rate of change in torsional rigidity relative to length in the torsional rigidity sudden-change portion is larger than that in any other portion.

According to a second aspect of the present invention, provided is a golf club shaft using a tube body made by winding fiber-reinforced prepreg formed from reinforcing fibers impregnated with synthetic resin, wherein the tube body has a front end portion to which a club head is to be attached, a grip portion provided on the side opposite to the front end portion, and an intermediate portion between the front end portion and the grip portion, and wherein torsional rigidity in the grip portion is lower than that in the intermediate portion.

According to the first-aspect of the present invention, the golf club using a tube body made by winding fiber-reinforced prepreg formed from reinforcing fibers impregnated with synthetic resin, is characterized in that the tube body has a front end portion to which a club head is to be attached, a grip portion provided on the side opposite to the front end portion, and a torsional rigidity sudden-change portion provided between the front end portion and the grip portion, that torsional rigidity on the front end portion side in the torsional rigidity sudden-change portion is in a range of from 1 to 4 when torsional rigidity in the front end portion is assumed to be 1, wherein the maximum torsional rigidity in the grip portion is not smaller than 4.5 when torsional rigidity on the front end portion is assumed to be 1, and that the rate of change in torsional rigidity relative to length in the torsional rigidity sudden-change portion is larger than that in any other portion.

In the first aspect, when the torsional rigidity in the front end portion is assumed to be 1, the torsional rigidity on the front end portion side in the torsional rigidity sudden-change portion is defined to fall within a range of from 1 to 4. This is to reduce the rate of increase of the torsional rigidity in that area to thereby disperse distortion over a long range in the area. As a result, it is possible to obtain a golf club shaft by which a golf player is easy to sense the torsional-condition and which is superior in handling performance. It is also possible to prevent damage from being caused by local torsion in the front end portion. In addition, when the torsional rigidity in the front end portion is assumed to be 1, the torsional rigidity in the rear end portion of the grip portion is defined to be 4.5 or more. This is to prevent right and left hands gripping the shaft from getting out of position due to torsion in swinging operation. It is therefore possible to obtain a golf club shaft which is superior in handling performance, and superior in sense of stability (sense of security).

In the first aspect, the rate of change of the torsional rigidity relative to the length in the torsional rigidity sudden-change portion is made larger than that in any other portion. This is to relieve unpleasant torsional vibrations which would be generated by a mistaken hit, by the effect of the torsional rigidity sudden-change portion.

According to the second aspect of the present invention, a golf club shaft using a tube body made by winding fiber-reinforced prepreg formed from reinforcing fibers impregnated with synthetic resin, is characterized in that the tube body has a front end portion to which a club head is to be attached, a grip portion provided on the side opposite to the front end portion, and an intermediate portion between the front end portion and the grip portion, and that torsional rigidity in the grip portion is lower than that in the intermediate portion.

In the second aspect, torsional rigidity in the grip portion is set to be lower than that in the intermediate portion. This is because if the grip portion side is made easy to be distorted, a sense of hitting a ball is made soft to soften an impact against hands.

In the first and second aspects, the fiber-reinforced prepreg is formed by impregnating reinforcing fibers with synthetic resin. Carbon fibers, glass fibers, alumina fibers, alamide fibers, etc. are available as the reinforcing fibers. Epoxy resin, phenolic resin, polyester, etc. can be used as the synthetic resin.

It is another object of the present invention to provide a golf club shaft which can be swung out easily, and which is superior in strength and balance thereof.

As a result of deep consideration on the flexibility, rigidity and balance of strength in a golf club shaft, the present inventors found a shape with which the golf club is easy to perform swinging operation, easy to be gripped, and good in appearance, and with which the flying distance can be extended. Thus, the inventors have reached the present invention.

According to a third aspect of the present invention, provided is a golf club shaft constituted by fiber-reinforced prepreg formed from reinforcing fibers impregnated with synthetic resin, wherein a small-diameter portion is provided on a head side, a large-diameter portion is provided on a grip side, and a tapered portion is provided between the small-diameter portion and the large-diameter portion, and wherein an outer diameter at the rear end portion of the small-diameter portion is made smaller by 2 mm or more than an outer diameter at the front end portion of the large-diameter portion, and bending rigidity at the rear end portion is made to be 60 to 100% of that at the front end portion.

According to a fourth aspect of the present invention, provided is a golf club shaft constituted by a tube body made by winding fiber-reinforced prepreg formed from reinforcing fibers impregnated with synthetic resin, wherein a small-diameter portion with a comparatively gentle taper having a diameter which decreases as a position goes from a grip side toward a head side, is provided on the head side, a large-diameter portion with a comparatively gentle taper having a diameter which decreases as a position goes from the grip side toward the head side is provided on the grip side, and a tapered portion with a larger taper than either of the first and second mentioned tapers is provided between the small-diameter portion and the large-diameter portion; wherein the small-diameter portion is longer in length than half of the tube body, and the large-diameter portion is longer in length than the tapered portion, but shorter than the small-diameter portion; and wherein an outer diameter of the small-diameter portion at its rear end portion is made smaller by 2 mm or more than an outer diameter of the large-diameter portion at its front end portion.

According to a fifth aspect of the present invention, provided is a golf club shaft constituted by fiber-reinforced prepreg formed from reinforcing fibers impregnated with synthetic resin, wherein a small-diameter portion with a comparatively gentle taper having a diameter which decreases as a position goes from a grip side toward a head side is provided on the head side, a large-diameter portion with a comparatively gentle taper having a diameter which decreases as a position goes from the grip side toward the head side is provided on the grip side, and a tapered portion with a larger taper than either of the first and second mentioned tapers is provided between the small-diameter portion and the large-diameter portion; and wherein the taper of the tapered portion is 20/1,000 to 120/1,000.

The golf club shaft according to the present invention is applicable to a wood, an iron, a putter, and so on.

The third aspect of the present invention is such that a small-diameter portion is provided on a head side, a large-diameter portion is provided on a grip side, and a tapered portion is provided between the small-diameter portion and the large-diameter-portion, and wherein an outer diameter of the small-diameter portion at its rear end portion is made smaller by 2 mm or more than an outer diameter of the large-diameter portion at its front end portion, and bending rigidity at the rear end portion is made to be 60 to 100% of that at the front end portion.

In the third aspect, the outer diameter in the rear end portion of the small-diameter portion is set to be smaller by 2 mm or more than the outer diameter in the front end portion of the large-diameter portion. This is because, if the outer diameter difference is less than 2 mm, the outer diameter of the small-diameter portion is not enough to reduce air resistance in swinging operation.

In the third aspect, the bending rigidity in the rear end portion of the small-diameter portion is set to be in a range of from 60% to 100%, preferably in a range of from 70% to 90%, of the bending rigidity in the front end portion of the large-diameter portion. This is because, if the bending rigidity in the rear end portion of the small-diameter portion is less than 60% of that in the front end portion of the large-diameter portion, flexibility is concentrated in the rear end portion of the small-diameter portion in swinging operation so as not only to make swinging difficult but also to cause damage.

The fourth aspect of the present invention is such that a small-diameter portion with a comparatively gentle taper having a diameter which decreases as a position goes from a grip side toward a head side, is provided on the head side, a large-diameter portion with a comparatively gentle taper having a diameter which decreases as a position goes from the grip side toward the head side is provided on the grip side, and a tapered portion with a larger taper than either of the first and second mentioned tapers is provided between the small-diameter portion and the large-diameter portion; wherein the small-diameter portion is longer in length than half of the tube body, and the large-diameter portion is longer in length than the tapered portion, but shorter than the small-diameter portion; and wherein an outer diameter of the small-diameter portion at its rear end portion is made smaller by 2 mm or more than an outer diameter of the large-diameter portion at its front end portion.

In the fourth aspect, the term "comparatively gentle taper" means the taper includes a straight (not-tapered) shape, and specifically, it is in a range of from 0/1,000 to 5/1,000.

In the fourth aspect, taking air resistance in swinging operation into consideration, the small-diameter portion is set to be longer than half of the shaft. In addition, taking the length of a grip into consideration, the large-diameter portion is set to be larger than the tapered portion and shorter than the small-diameter portion.

Also in the fourth aspect, in the same manner as in the third aspect, the outer diameter in the rear end portion of the small-diameter portion is set to be smaller by 2 mm or more than the outer diameter in the front end portion of the large-diameter portion.

In the fourth aspect, preferably, the thickness is made increased as a position goes from the head side of the small-diameter portion toward the grip side. If the thickness is adjusted in such a manner, it is possible to improve the balance of flexibility of the shaft, and it is also possible to prevent concentration of stress such as bending. Consequently it is possible to improve the strength of the shaft.

In the third and fourth aspects, the front end portion of the large diameter portion is indicated by D of FIG. 1 and the rear end portion of the small diameter portion is indicated by C of FIG. 1.

The fifth aspect of the present invention is such that a small-diameter portion with a comparatively gentle taper having a diameter which decreases as a position goes from a grip side toward a head side is provided on the head side, a large-diameter portion with a comparatively gentle taper having a diameter which decreases as a position goes from the grip side toward the head side is provided on the grip side, and a tapered portion with a larger taper than either of the first and second mentioned tapers is provided between the small-diameter portion and the large-diameter portion; and wherein the taper of the tapered portion is 20/1,000 to 120/1,000.

In the fifth aspect, the term "comparatively gentle taper" has the same meaning as that in the fourth aspect.

In the fifth aspect, the taper of the tapered portion is set to be in a range of from 20/1,000 to 120/1,000. This is because if the taper of the tapered portion is less than the lower limit of the above-mentioned range, the external form of the small-diameter portion becomes large to increase air resistance in swinging operation, and if the taper exceeds the upper limit of the above-mentioned range, the external form changes suddenly so as to produce meanders or twisting of reinforcing fibers to thereby reduce the strength.

In the third to fifth aspects, taking air resistance in swinging operation into consideration, the outer diameter of the rear end portion of the small-diameter portion is preferably set to be in a range of from 9.0 mm to 12.5 mm, while taking the outer diameter of the grip into consideration, the outer diameter of the front end portion of the large-diameter portion is preferably set to be in a range of from 13.5 mm to 15.0 mm.

In the fourth to fifth aspects, the total length of the shaft is usually selected to be in a range of from 800 mm to 1,200 mm though it varies in accordance with clubs to which the invention is applied.

In addition, the first to fifth aspects can be carried out in any combination desirably.

DETAILED DESCRIPTION OF THE PREFERRED EMBODIMENTS

Preferred embodiments of the present invention will be described below specifically with reference to the drawings. In the characteristic diagrams of FIG. 2, and FIGS. 4 to 7, the right side on the paper as one faces is the grip portion side, while the left side as one faces is the front end side.

Figure 1:
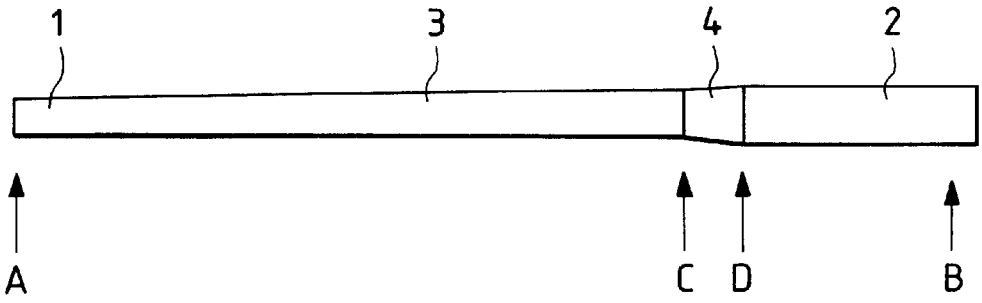
FIG. 1 is a front view illustrating an embodiment of a tube body constituting a golf club shaft according to the first aspect of the present invention.

FIG. 1 is a front view illustrating an embodiment of a tube body constituting a golf club shaft according to the present invention. This tube body has a front end portion 1 to which a club head (not-shown) will be attached, a grip portion 2 provided on the rear end side opposite to the front end portion 1, an intermediate portion 3 connected to the front end portion 1, and a torsional rigidity sudden-change portion 4 provided between the intermediate portion 3 and the grip portion 2. In FIG. 1, although the torsional rigidity sudden-change portion 4 is formed into a tapered shape, it is not limited to the tapered shape, but may be constituted by laminating constituent materials.

Figure 2:
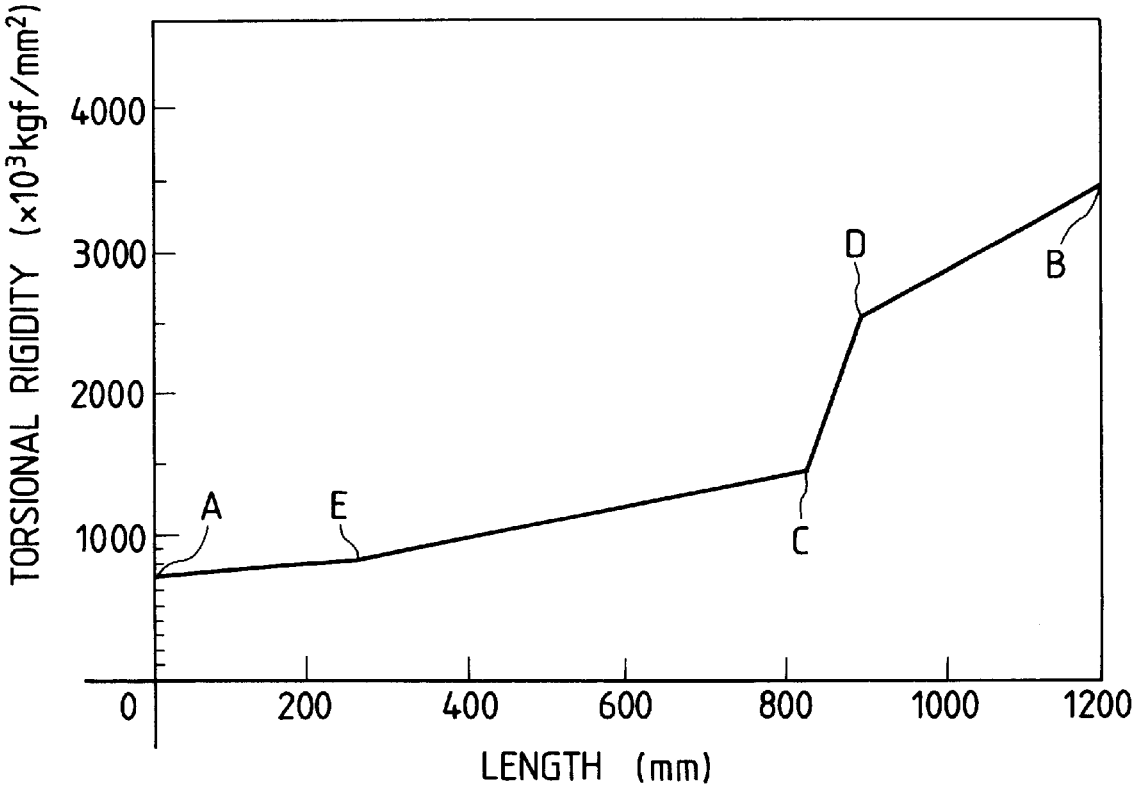
FIG. 2 is a characteristic diagram showing the distribution of torsional rigidity in the golf club shaft according to the first aspect of the present invention.

This tube body is about 1,200 mm long, and has a distribution of torsional rigidity shown in FIG. 2. That is, in FIG. 2, this distribution has a gentle right-upslope from a front end portion A to a portion E distant by 250 to 300 mm from the portion A, a little-more-sudden right-upslope than the above-mentioned upslope from the portion E to a portion C of the torsional rigidity sudden change portion located at a front end side of said sudden-change portion and located at least ⅔ the length of the golf club from the front end portion A, the torsional rigidity at portion C being no larger than $1{,}500\times10^3$ KG*mm$^2$, a very sudden right-upslope from the portion C to a front end portion D of the grip portion, and a more gentle right-upslope than the sudden upslope from the portion D to a rear end portion B of the grip portion. The tube body is about 1,200 mm long and the front end portion is at least 250 mm long, the grip portion is at least 300 mm long and said intermediate portion is at least 500 mm long.

Specifically, the torsional rigidity at the portion A of the front end portion is $700\times10^3$ kg*/mm$^2$, the torsional rigidity at the torsional rigidity sudden-change portion, for example, in the portion C is $1{,}400\times10^3$ kg*/mm$^2$, and the torsional rigidity at the rear end portion B of the grip portion is about $3{,}600\times10^3$ kg*/mm$^2$. In this case, when the torsional rigidity at the portion A of the front end portion is assumed to be 1, the torsional rigidity at the torsional rigidity sudden-change portion, for example, at the portion C is 1.25, and the torsional rigidity at the rear end portion B of the grip portion is 4.5. The grip portion has a torsional rigidity of at least $2{,}500\times10^3$ kgf*mm$^2$.

In addition, preferably the ratio of the rate of change in torsional rigidity (the change in torsional rigidity per length) between the section from E to C to the section from C to D is 1:1.5 or more, more preferably 1:2 or more.

In the tube body having such a distribution of torsional rigidity, the rate of increase of the torsional rigidity from the portion A of the front end portion to the portion C of the torsional rigidity sudden-change portion is reduced. It is therefore possible to disperse torsion over a long range from the portion A to the portion C, so that it is possible to prevent damage from being caused by local torsion in the portion A of the front end portion. Accordingly, it is possible to improve or stabilize the strength of the golf club shaft.

In addition, in the tube body having such a distribution of torsional rigidity, the torsional rigidity in the grip portion is so high that it is possible to prevent right and left hands gripping the shaft from getting out of position due to torsion in swinging operation. Consequently, it is possible to obtain a golf club shaft which is superior in handling performance, and superior in a sense of stability (a sense of security).

Figure 3A:
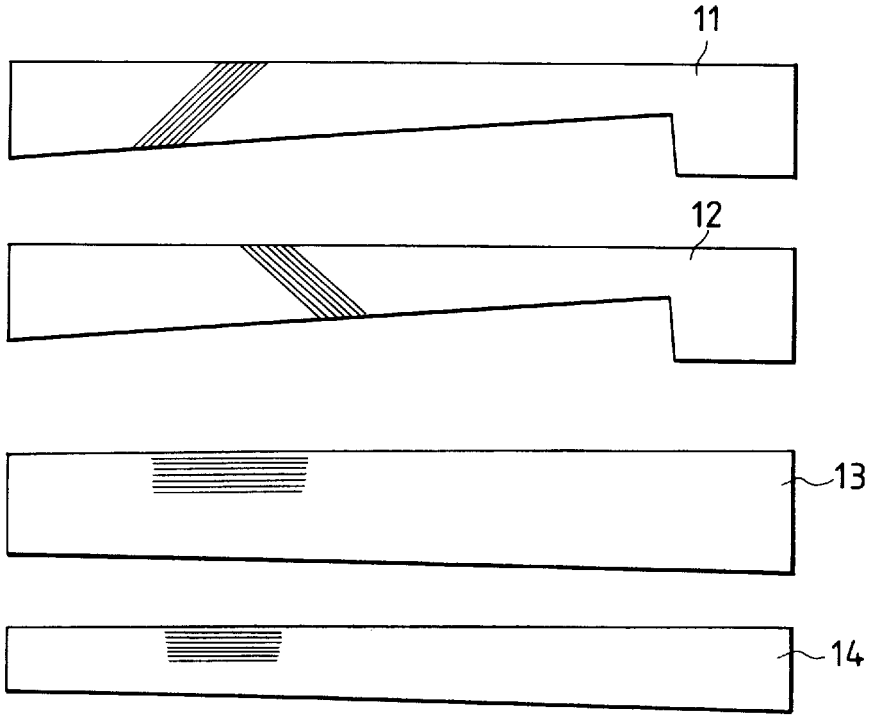
FIGS. 3(A) and 3(B) are diagrams for explaining a method of manufacturing the golf club shaft according to the first aspect of the present invention.

The tube body with the above-mentioned structure can be manufactured by winding prepregs shown in the diagrams (A) and (B) of FIG. 3 on a mandrel (not-shown). Line directions in the respective prepregs shown in FIGS. 3(A) and (B) designate the directions of fibers, and the number of plies can be changed variously in accordance with usage, required characteristics, and so on.

In FIG. 3(A), the reference numerals 11 and 12 represent AP prepregs (where reinforcing fibers arranged in a direction inclined relative to the axial direction are impregnated with synthetic resin) constituting a body layer. Each of these AP prepregs 11 and 12 has an approximate L shape which becomes narrower gradually as a position goes from the area of the front end portion area toward the area of the grip portion, and wide in the area of the grip portion. In addition, these AP prepregs 11 and 12 are prepregs the fiber directions of which are inclined in two directions, for example, by ±45° relative to the axial direction, so that it will go well if the shaft is distorted in either direction. The fiber directions of the respective prepregs 11 and 12 are not limited to the directions of ±45° relative to the axial direction, but may be made in a range of from about 30° to about 55° (−30° to −55°) relative to the axial direction. Prepregs having reinforcing fibers the fiber direction of which is beyond this range can be also used. The AP prepregs 11 and 12 are set so that their quantity of synthetic resin impregnation is in a range of from about 15% in weight to about 35% in weight.

In FIG. 3(A), the reference numerals 13 and 14 represent SP prepregs (where reinforcing fibers arranged in the axial direction are impregnated with synthetic resin) constituting a body layer. Although prepregs the thickness of which is within a range of from 0.05 mm to 0.25 mm are used as the SP prepregs herein, they are not particularly limited thereto. The fiber directions may be inclined in a range of ±5°, or a range of ±15° relative to the axial direction.

Figure 3B:
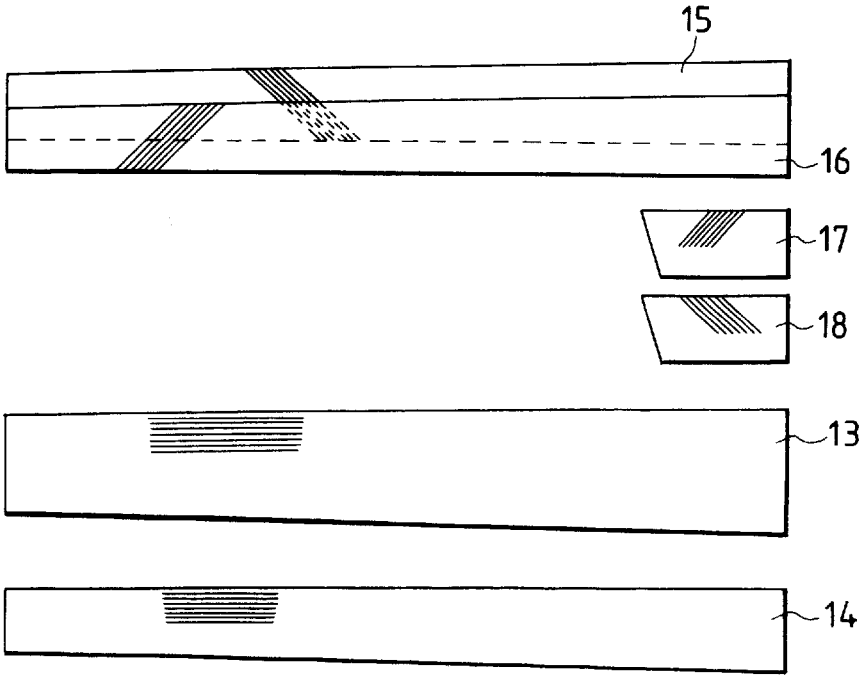

In FIG. 3(B), the reference numerals 15 and 16 represent AP prepregs constituting a body layer. These AP prepregs are similar to the AP prepregs shown in FIG. 3(A), except that they are approximately rectangular. In addition, SP prepregs in FIG. 3(B) are similar to the SP prepregs shown in FIG. 3(A).

In FIG. 3(B), the reference numerals 17 and 18 represent prepregs reinforcing the grip portion. These prepregs 17 and 18 may be constituted by a UD sheet, for example, in which carbon fibers are arranged in one direction, or by woven fabric, or by a combination of woven fabric and a UD sheet. In addition, the fiber direction may be the circumferential direction or the axial direction besides the direction inclined relative to the axial direction as shown in FIG. 3(B). With the fiber direction set circumferentially, the strength against the crushing direction is improved, while with the fiber direction oriented so as to be inclined relative to the axial direction, the strength against the torsional direction is improved.

Although the thickness of the prepregs 17 and 18 can be set arbitrarily, it is preferable to make them thinner than any other prepreg of the body layer for the purpose of allowing a step generated in a winding end portion, preventing fibers of the body layer from meandering, etc.

In FIG. 3(A) and FIG. 3(B), although the thickness of the AP prepregs 11, 12, 15 and 16 can be set arbitrarily, it is preferable to make them thinner than either of the SP prepregs 13 and 14 constituting the body layer, because reinforcing fibers are oriented to cross each other. In addition, preferably, the number of windings in any AP prepreg is made larger than that in any SP prepreg. In accordance with conditions, any AP prepreg may be made thicker than any SP prepreg, and the number of windings in the AP prepreg may be made smaller than that in the SP prepreg. When AP prepregs different in their fiber directions are designed to be laid on each other. This is to prevent generation of an uneven section, it is preferable to make the total thickness substantially equal to or not to be thicker than twice of the thickness of the body layer constituted by SP prepregs. In addition, in order to improve the torsional rigidity (effectively), it is preferable to select the elasticity of the reinforcing fibers used in the AP prepregs to be higher than that in the reinforcing fibers used in the SP prepregs of the body layer.

A club head is attached to the tube body manufactured thus by an ordinary method, so that a golf club shaft can be obtained.

Figure 4:
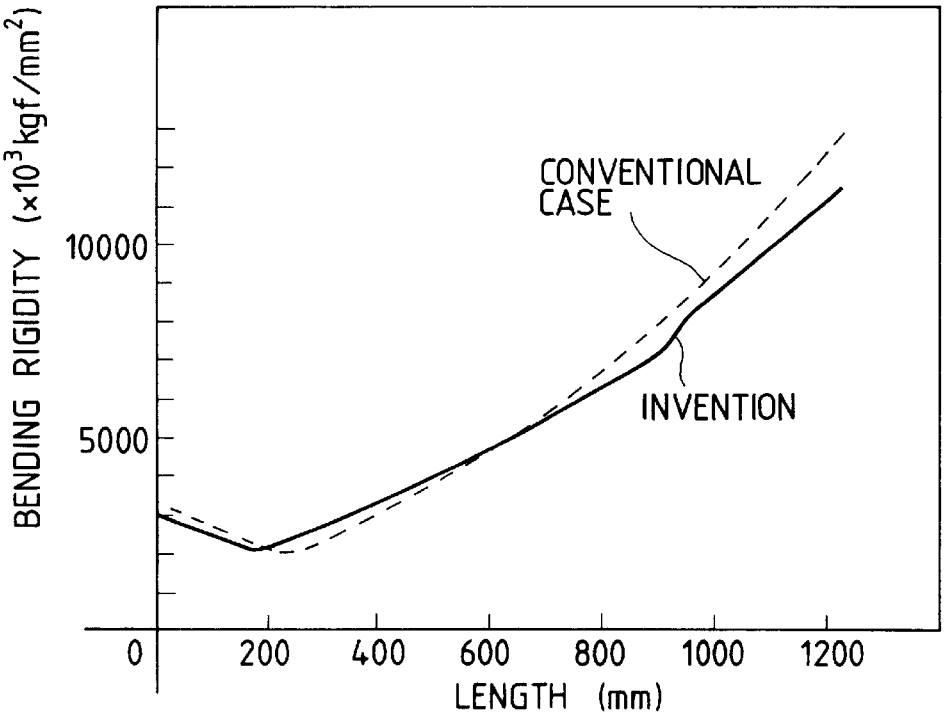
FIG. 4 is a characteristic diagram showing the distribution of bending rigidity in a golf club shaft according to the second aspect of the present invention.
Figure 5:
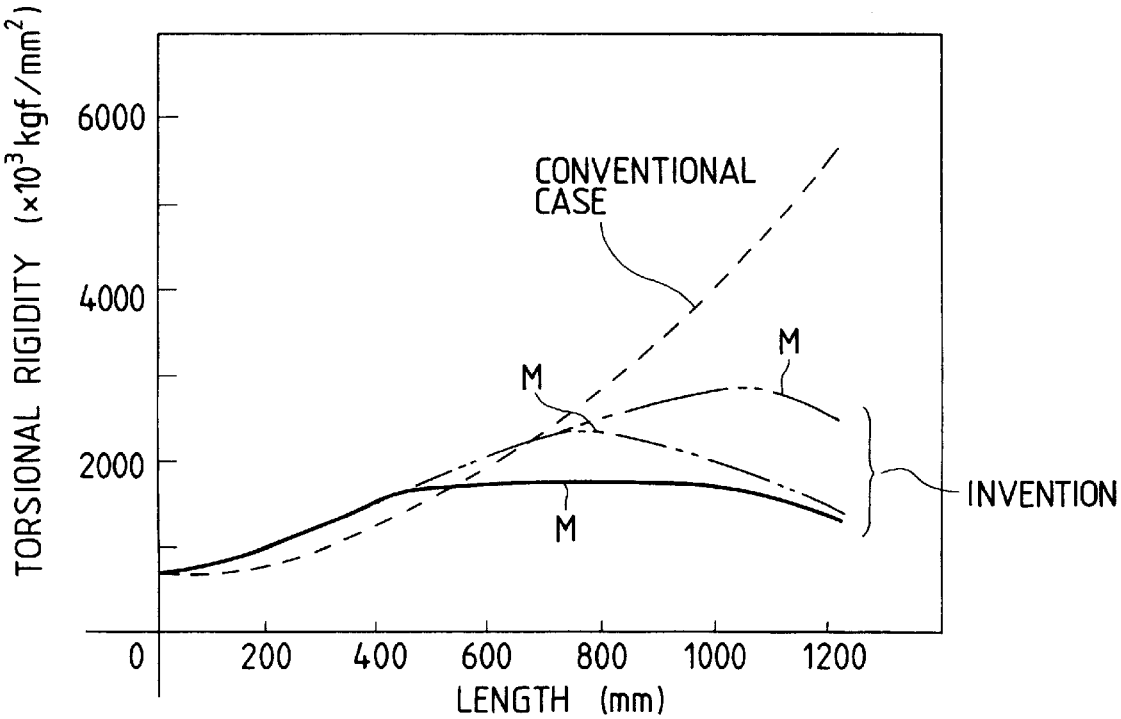
FIG. 5 is a characteristic diagram showing the distribution of torsional rigidity in the golf club shaft according to the second aspect of the present invention.

FIG. 4 is a characteristic diagram showing the distribution of bending rigidity in a tube body constituting a golf club shaft according to the second aspect of the present invention, and FIG. 5 is a characteristic diagram showing the distribution of torsional rigidity in the tube body constituting the golf club shaft according to the second aspect of the present invention. In FIGS. 4 and 5, the dotted line shows a conventional golf club shaft tube body, and the solid line and the two-dotted chain line show a golf club shaft tube body according to the present invention.

As shown in FIG. 5, if the torsional rigidity in the grip portion is set to be lower than that in the intermediate portion, the shaft is easy to be gripped on the grip portion side. Accordingly, the sense of hitting becomes soft, and an impact on hands is softened. In addition, the torsional rigidity between the front end portion and the intermediate portion is comparatively high, so that the directional property is improved. Particularly, if the torsional rigidity on the rear end portion side of the grip portion is reduced, impact and vibrations are transmitted softly to a back hand which is gripping strongly.

In FIG. 5, it is preferable to set the position of the maximum value M of the torsional rigidity to be within a range of from 40% to 90% of the whole length from the front end portion. In addition, it is preferable to set the torsional rigidity at the rear end portion to be 85% or less of the maximum value M. More preferably, it is 75% to 35% of the maximum value M. The reason why it is made 35% or more of the maximum value M is that prevention of the shaft from being broken is taken into consideration.

Figure 6:
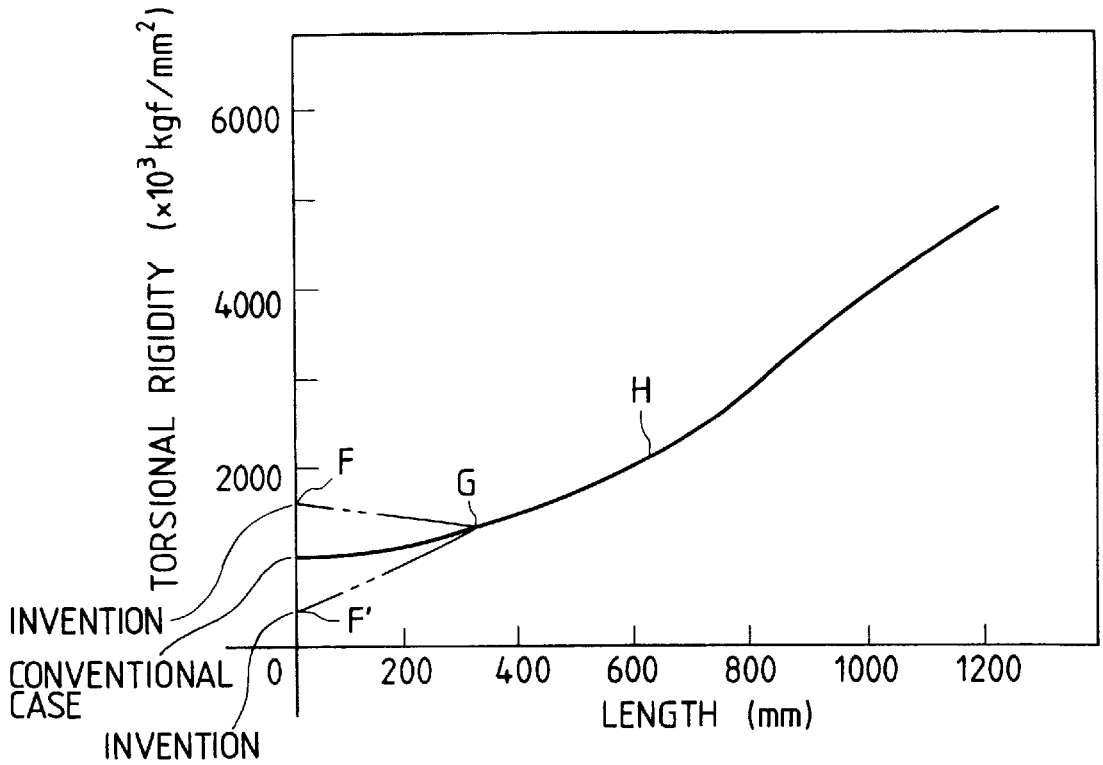
FIG. 6 is a characteristic diagram showing the distribution of torsional rigidity in a golf club shaft according to another embodiment of the present invention.
Figure 7:
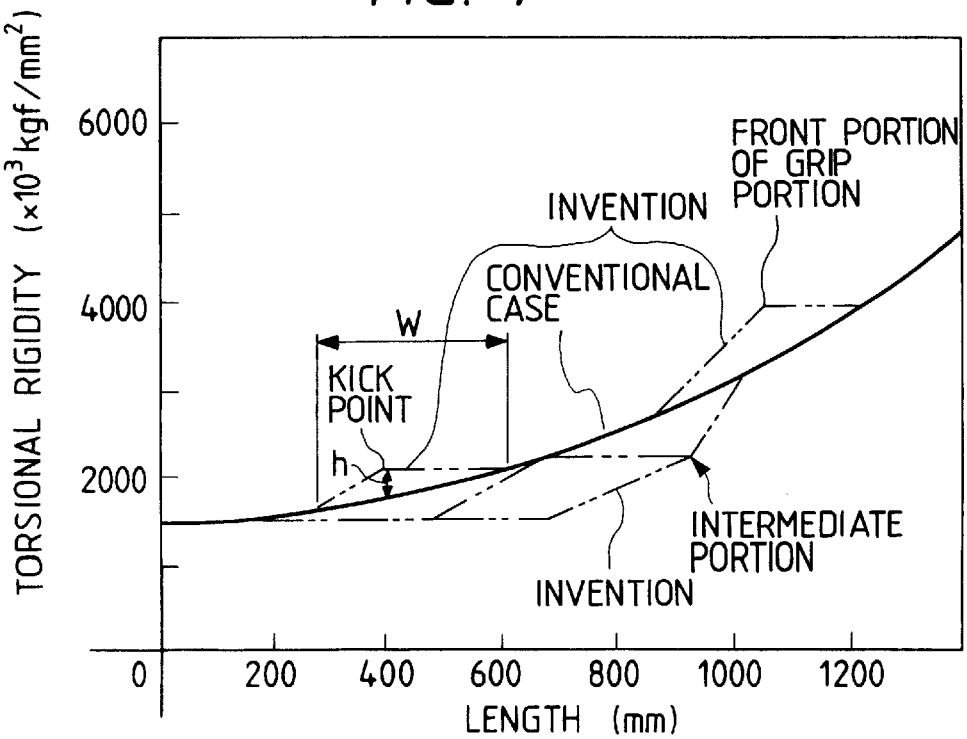
FIG. 7 is a characteristic diagram showing the distribution of torsional rigidity in a golf club shaft according to another embodiment of the present invention.

In addition, according to the present invention, it is possible to obtain various characteristics by a golf club shaft using a tube body having a distribution of torsional rigidity shown in FIGS. 6 and 7. That is, in FIG. 6, the torsional rigidity in the front end portion is made higher than that is in the conventional case, so that it is possible to reduce the quantity of torsion of the front end portion without increasing the total torsional rigidity of the shaft, and it is possible to reduce torsion generated in the front end portion without making the sense of hitting hard. Further, the directional property is also improved. In addition, the torsional rigidity in the front end portion of the shaft which will be inserted into and bonded with a club head is brought close to the torsional rigidity in the shaft-inserted portion of the club head, so that a rigidity difference in the torsional rigidity between the club head side and the shaft side is reduced, so that concentration of stress caused by torsion can be relieved.

In addition, in this case, preferably, the ratio (F/G) of the torsional rigidity in a position F to the torsional rigidity in a position G is 1.0 or more, more preferably 1.2 or more. In addition, preferably, the position G is set to be 25% or less of the total length from the front end portion, more preferably 20% or less.

On the other hand, in FIG. 6, if the torsional rigidity in the front end portion is made lower than that in the conventional case, the front end portion becomes easier to be distorted, so that the club head is easy to turn at the time of hitting a ball. Accordingly, it is possible to increase the gear effect of the club head.

In addition, in this case, assume a portion H on the rear end portion side from the portion G by a distance corresponding to the distance between a portion F' and the portion G. Then, it is preferable to select the ratio (F' to G:G to H) of the rate of change in the torsional rigidity between the portion F' and the portion G to the rate of change in the torsional rigidity between the portion G and the portion H to be 1:1.1 or more, more preferably 1:1.2 or more.

In FIG. 7, if the torsional rigidity on the front end portion side (kick point) of the intermediate portion is made higher than that in the conventional case, it is possible to improve the sense of reliance (such a sense in swinging operation that swing could be performed without shaking) at the kick point. In FIG. 7, if the torsional rigidity in the front portion of the grip portion is made higher than that in the conventional case, it is possible to improve the sense of reliance. Further, in FIG. 7, if the torsional rigidity in the intermediate portion is made lower than that in the conventional case, it is possible to make it easy to sense the condition of torsion in swinging operation.

In addition, if the bending rigidity between the front end side and the handling side (rear end portion side) in the grip portion is adjusted, it is possible to improve the sense of reliance in gripping, and it is possible not to make the shaft hard.

In addition, in this case, if the region W within which the torsional rigidity on the front end portion side (kick point) of the intermediate portion is made higher or lower than that in the conventional case is made to be 100 mm or more, preferably 200 to 400 mm, it is possible to prevent the shaft from being broken or to prevent the solid state properties of the shaft from scattering caused by the local change of the torsional rigidity. Further, it is preferable to adjust a difference h with which the torsional rigidity is made higher or lower than that in the conventional case (a reference value) within a range of from ±15% to ±45% of the reference value. This is because that a sufficient effect cannot be obtained if the difference h is less than ±15% of the reference value, and there is a disadvantage on strength if the difference h exceeds ±45%.

Such a distribution of the torsional rigidity or such a distribution of the bending rigidity in the tube body can be realized by adjusting the shape of wound prepregs, the fiber direction thereof, the thickness thereof, the quantity of synthetic resin impregnation, the modulus of elasticity of the fibers, and so on.

As has been described above, in a golf club shaft according to the present invention, various characteristics can be optimized by adjusting the distribution of torsional rigidity or the distribution of bending rigidity in a tube body as a whole.

Figure 8:
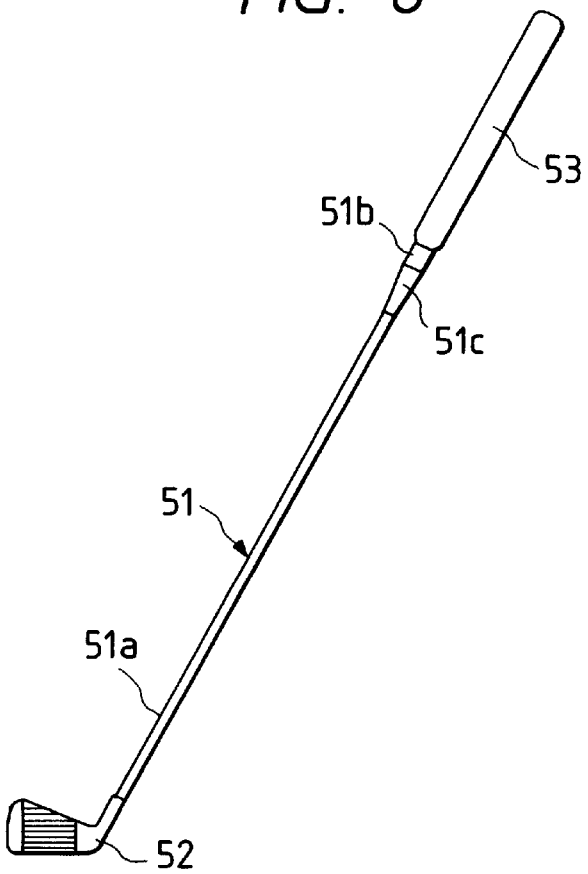
FIG. 8 is a perspective view illustrating a golf club using a golf club shaft according to the present invention.

FIG. 8 is a perspective view illustrating an embodiment of a golf club using a golf club shaft according to the present invention. In FIG. 8, the reference numeral 51 represents a shaft body. The shaft body 51 has a small-diameter portion 51*a* on the head side, a large-diameter portion 51*b* on the grip side, and a tapered portion 51*c* between the small-diameter portion 51*a* and the large-diameter portion 51*b*.

A club head 52 (herein an iron head) is attached to top of the head-side of the small-diameter portion 51*a* of the shaft body 51 by a method such as bonding, integral molding, or the like. In addition, a grip 53 is attached to the grip side of the large-diameter portion 51*b* of the shaft body 51 by a method such as bonding, or the like.

Figure 9:
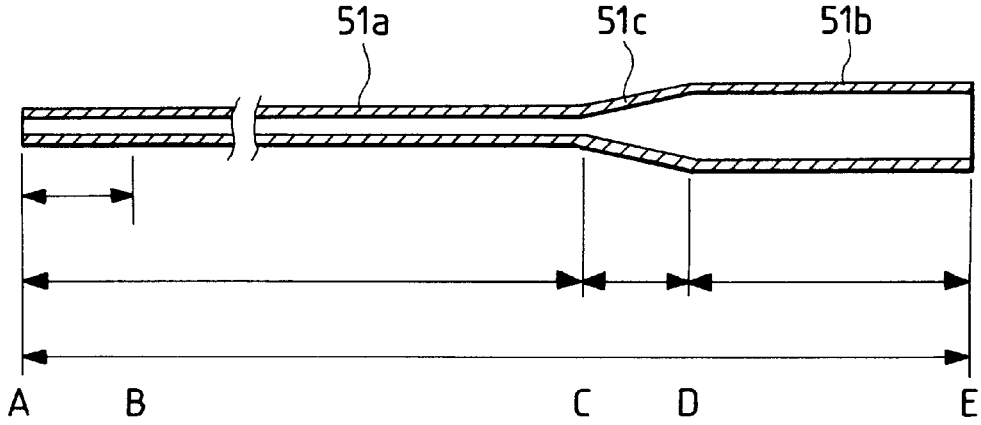
FIG. 9 is a main part sectional view illustrating the golf club shaft according to the present invention.

FIG. 9 is a sectional view illustrating the shaft body 1 shown in FIG. 8. In FIG. 9, the portion from A to E shows the total length of the shaft body 51, the portion from A to C shows the length of the small-diameter portion 51*a*, the portion from C to D shows the tapered portion 51*c*, and the portion from D to E shows the large-diameter portion 51*b*. The portion from A to B corresponds to a fixation portion for fixing the club head 52. In addition, C represents the rear end portion of the small-diameter portion, and D represents the front end portion of the large-diameter portion.

In this embodiment, the total length (from A to E) of the shaft body 51 is 1,120 mm (45 inches club), the length of the small-diameter portion 51*a* (from A to C) is 790 mm, the length of the tapered portion 51*c* (from C to D) is 60 mm, the length of the large-diameter portion 51*b* (from D to E) is 270 mm (240 to 280 mm), and the length of the fixation portion (from A to B) is 150 mm. In addition, the outer diameter of the front end portion (A) of the small-diameter portion 51*a* is 8.4 mm (7 to 9.5 mm), while the outer diameter of the rear end portion (C) of the small-diameter portion 51*a* is 11.40 mm (10 to 12.5 mm). The outer diameter of the front end portion (D) of the large-diameter portion 51*b* is 14.1 mm (13.5 to 16.0 mm), while the outer diameter of the rear end portion (E) of the large-diameter portion 51*b* is 15.5 mm (14.0 to 20.0 mm). The outer diameter at the portion B is 8.5 mm. When the shaft is set to have such size, it is possible to replace the grip by an existing one and in a conventional manner, easily.

In the golf club shaft in this embodiment, as mentioned above, the length of the small-diameter portion 51*a* occupies about 60% or more of the total length of the shaft body 51, and hence the small-diameter portion is longer than half of the shaft body 51. In addition, the large-diameter portion 51*b* is longer than the tapered portion 51*c,* and shorter than the small-diameter portion 51*a.*

In addition, the taper of the small-diameter portion 51*a* is about 4/1,000, the taper of the tapered portion 51*c* is about 45/1,000, and the taper of the large-diameter portion 51*b* is about 5/1,000, so that the taper of the tapered portion 51*c* is within a range of from 20/1,000 to 120/1,000, larger than either of the tapers of the small-diameter portion 51*a* and the large-diameter portion 51*b.*

In addition, the outer-diameter difference between the rear end portion (C) of the small-diameter portion 51*a* and the front end portion (D) of the large-diameter portion 51*b* is 2.7 mm. The small-diameter portion 51*a* is made thicker as the position goes from its head side (B) toward its grip side.

Figure 10:
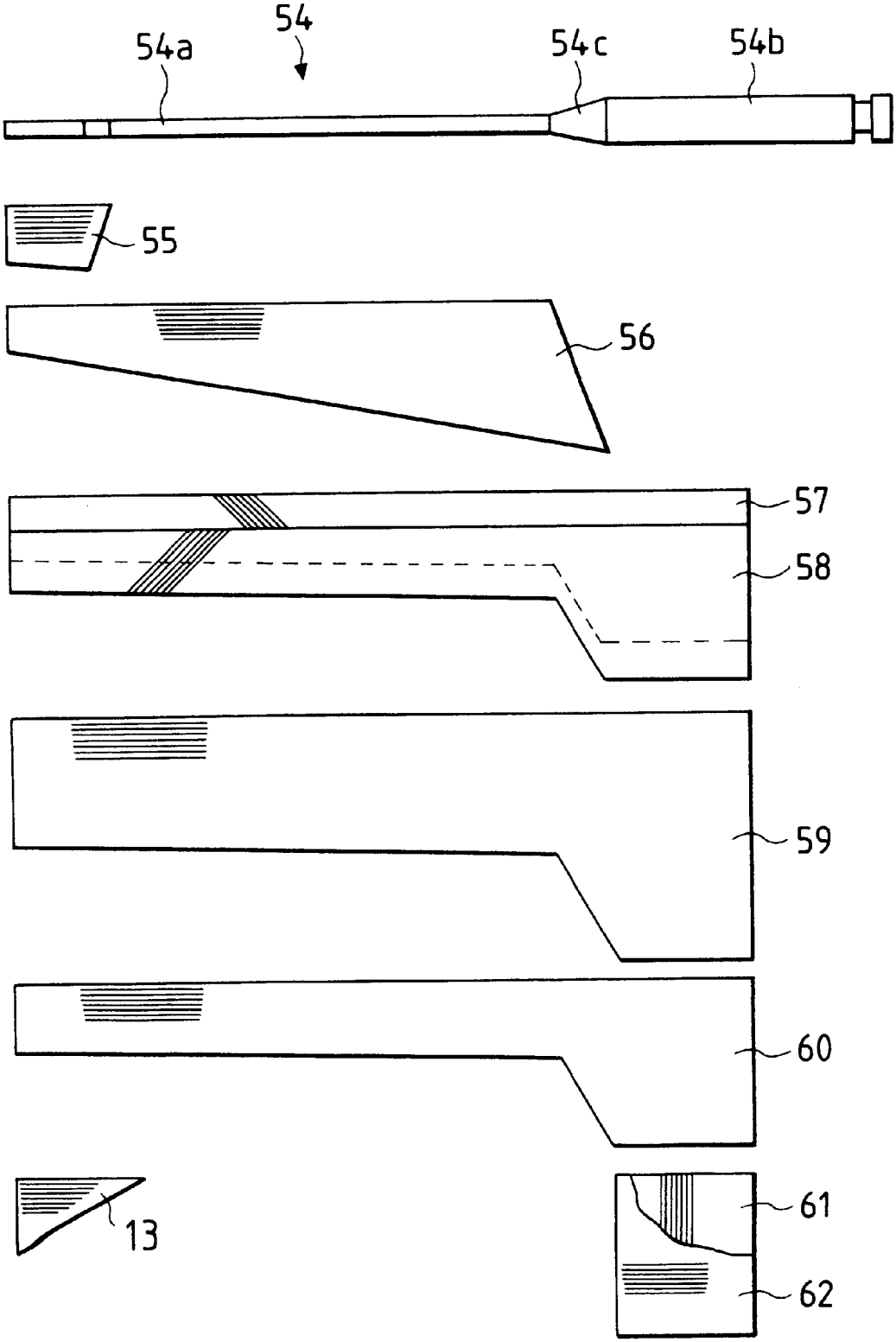
FIG. 10 is a diagram for explaining a process of manufacturing the golf club shaft according to the present invention.

The golf club shaft having such a configuration is manufactured as follows. First, prepregs referenced by the numerals 55 to 63 are wound on a mandrel 54 shown in FIG. 10 (wherein the portions 54*a,* 54*b* and 54*c* correspond to the small-diameter portion 51*a,* the large-diameter portion 51*b,* and the tapered portion 51*c,* respectively) sequentially and individually, or adjacent prepregs desirably overlapped on each other in advance are wound at the same time on the mandrel 54. Thereafter, the manufacturing is completed through ordinary steps of fastening by taping, heat hardening, removing a mandrel, removing a tape, grinding, etc. The directions of hatchings in the respective prepregs shown in FIG. 10 designate fiber directions, and the number of plies may be changed variously in accordance with purposes, required characteristics, etc. In addition, in FIG. 10, a body layer as a base is constituted by the first to fifth prepregs 56 to 60. In FIG. 10, the reference numeral 55 represents a front-end reinforcing prepreg; 61 and 62, grip prepregs; and 63, a reinforcing prepreg.

The front-end reinforcing prepreg 55 is a prepreg for reinforcing the front end portion of the shaft. This prepreg 55 may be constituted by a unidirectional sheet (UD sheet) in which, for example, carbon fibers are arranged in the axial direction, or by woven cloth or a combination of woven cloth and a UD sheet. The fiber direction may be the circumferential direction, or a direction oriented with an inclination relative to the axial direction, besides the axial direction. If the fiber direction is made circumferential, it is possible to improve the strength against the crushing direction. If the fiber direction is made to be a direction oriented with an inclination relative to the axial direction, it is possible to improve the strength against the twisting direction.

The quantity of synthetic resin impregnation in the front-end reinforcing prepreg 55 is selected to have an impregnation ratio larger than that in the body layer, which will be described later. Specifically, the quantity of synthetic resin impregnation is made to be about 28% or more in weight, preferably about 40% or more in weight. If the quantity is made to be about 40% or more in weight, adhesion to the mandrel 54 can be prevented so as to make it easy to remove the mandrel, and generation of bubbles can be prevented so as to prevent separation, etc.

Although the thickness of the front-end reinforcing prepreg 55 is arbitrary without any limitation, it is preferable that the front-end reinforcing prepreg 55 is made thinner than any prepreg of the body layer for the purposes of prevention of a difference in level, prevention of meanders of fibers in the body layer, and so on. If a reinforcing prepreg is wound partially in the longitudinal direction in a portion other than the front end portion, the prepreg may be constituted in such a manner as mentioned above.

In addition, material having a modulus of elasticity lower than that of fibers constituting a prepreg (SP prepreg) in which fibers arranged in the axial direction of the body layer are impregnated with synthetic resin, is preferably used for the fibers constituting the front-end reinforcing prepreg 55. If fibers having a modulus of elasticity lower than that of fibers constituting an SP prepreg is used, it is possible to obtain effects of improving the bending strength, and further, improving the strength against shearing and against impact. In addition, generally, material is selected which is smaller in specific gravity than fibers of a reinforcing prepreg used in the body layer or on the grip side. However, on the contrary, material with a large specific gravity may be used in order to adjust the total weight balance of the shaft.

The second and third body prepregs 57 and 58 are prepregs (AP prepregs) in which fibers arranged in a direction inclined relative to the axial direction of the body layer are impregnated with synthetic resin. The second and third body prepregs 57 and 58 are preferably constituted by prepregs in which fibers are inclined in two directions of, for example, ±45° relative to the axial direction so that the shaft may be distorted in either direction. In addition, these prepregs are preferably laid on each other by about half a ply in advance so that the prepregs are wound alternately. The fiber directions in the respective prepregs 57 and 58 are not limited to ±45°, but may be within a range of from about 30° to about 55° (−30° to −55°) relative to the axial direction. Or prepregs beyond this range may be used.

These second and third body prepregs 57 and 58 are designed so that the quantity of synthetic resin impregnation is low, that is, in a range of from about 10% to about 23% in weight, but it may exceed this range. In addition, when the second and third body prepregs 57 and 58 are wound on the inner layer side, bubbles are apt to be contained. Therefore, preferably, the quantity of synthetic resin impregnation is made more than that of the outside prepreg. On the contrary, even when the second and third body prepregs 57 and 58 are wound on the outer layer side, bubbles are apt to be contained. Therefore, preferably, the quantity of synthetic resin impregnation is made more than that of the inside prepreg.

Although the thickness of the second and third body prepregs 57 and 58 may be selected arbitrarily, inasmuch as fibers are oriented in cross, it is preferable to use prepregs thinner than any other body prepreg and to make the number of windings large. Alternatively, prepregs thinner than any other body prepregs may be used and the number of windings may be decreased. When those prepregs are constituted by prepregs in which fibers are laid on each other in different directions, it is preferable to make the prepregs to be substantially equal to or not thicker than twice of the thickness of any other body prepreg, because of prevention of ununiform section.

In addition, preferably, the second and third body prepregs 57 and 58 are constituted by fibers the elasticity of which is higher than that of fibers constituting other body prepregs, so that it is possible to improve the torsional rigidity (effectively) without reducing the bending elasticity. Specifically, since the bending modulus of elasticity decreases suddenly because fibers are inclined relative to the axial direction, it is preferable to select such a material that there arises a difference of 10 ton/mm$^2$ or more, preferably 20 ton/mm$^2$ or more, in modulus of elasticity between the two. That is, when the fibers constituting an SP prepreg has a modulus of elasticity of 30 ton/mm$^2$, the modulus of elasticity of fibers constituting an AP prepreg is preferably made higher so as to be 30 to 70 ton/mm$^2$.

In addition, in a prepreg the quantity of synthetic resin impregnation of which is small, the reinforcing fibers are better as the diameter thereof is thinner. For example, it is preferable to use carbon fibers having an average diameter of about 5.5 μm or less. This is because, if the diameter of fibers is large, a portion insufficiently filled with synthetic resin is generated easily. In addition, such a prepreg is apt to contain bubbles, and bubbles are apt to exist between layers.

The fourth body prepreg 59 is constituted by a UD sheet in which carbon fibers are arranged in the axial direction. In this embodiment, an SP prepreg is divided into a plural number, so that a prepreg on the surface layer side is designed to have a high content of resin, while a prepreg on the inner layer side has an extremely low content of resin. Specifically, the quantity of synthetic resin impregnation of the prepreg on the inner layer side is about 10 to 20% in weight, while the quantity of synthetic resin impregnation of the prepreg on the surface layer side is about 25 to 35% in weight.

Although the thickness of the fourth body prepreg used herein is within a range of from 0.05 to 0.25 mm, it is not limited to this range particularly. In addition, the fiber direction may be inclined relative to the axial direction within a range of ±5° or ±15°. Further, as for the reinforcing fibers, preferably, fibers with high density and high elasticity should be used. When the body layer is divided into layers as shown in this embodiment, the outer layer is made to have higher strength than the inner layer, and the inner layer may be made of high elastic fibers (prepreg).

As an outer layer of the fourth body prepreg arranged thus, further extremely thin (about 0.06 mm or less thick) fibers may be disposed circumferentially, or filaments may be wound spirally or in cheese winding. In this case, the quantity of synthetic resin impregnation is made larger than that of any other body prepreg. With such a layer formed as an outer layer of the fourth body prepreg, it is possible to obtain effects of preventing the body layers, improving the appearance, and so on.

The grip prepregs 61 and 62 may be provided between the third body prepreg 58 and the fourth body prepreg 59, or between the fourth body prepreg 59 and the fifth body prepreg 60. The reinforcing prepreg 63 is a prepreg for reinforcing the front end portion and the grip portion side of the shaft. The grip prepregs 61 and 62 and the reinforcing prepreg 63 are designed in the same manner as the front-end reinforcing prepreg 55.

Each of the prepregs 55 to 63 is a prepreg in which reinforcing fibers such as inorganic fibers such as carbon fibers, glass fibers, alumina fibers, boron fibers, etc.; or organic fibers such as alamide fibers, polyether imide fibers, etc.; are impregnated with synthetic resin such as thermosetting resin such as epoxy resin, phenolic resin, polyester, etc., thermoplastic resin, or the like. The fiber direction of the reinforcing fibers, the shape of the reinforcing fibers, the shape of the prepreg, the quantity of resin impregnation, etc. are selected suitably taking target characteristics into consideration.

Figure 11:
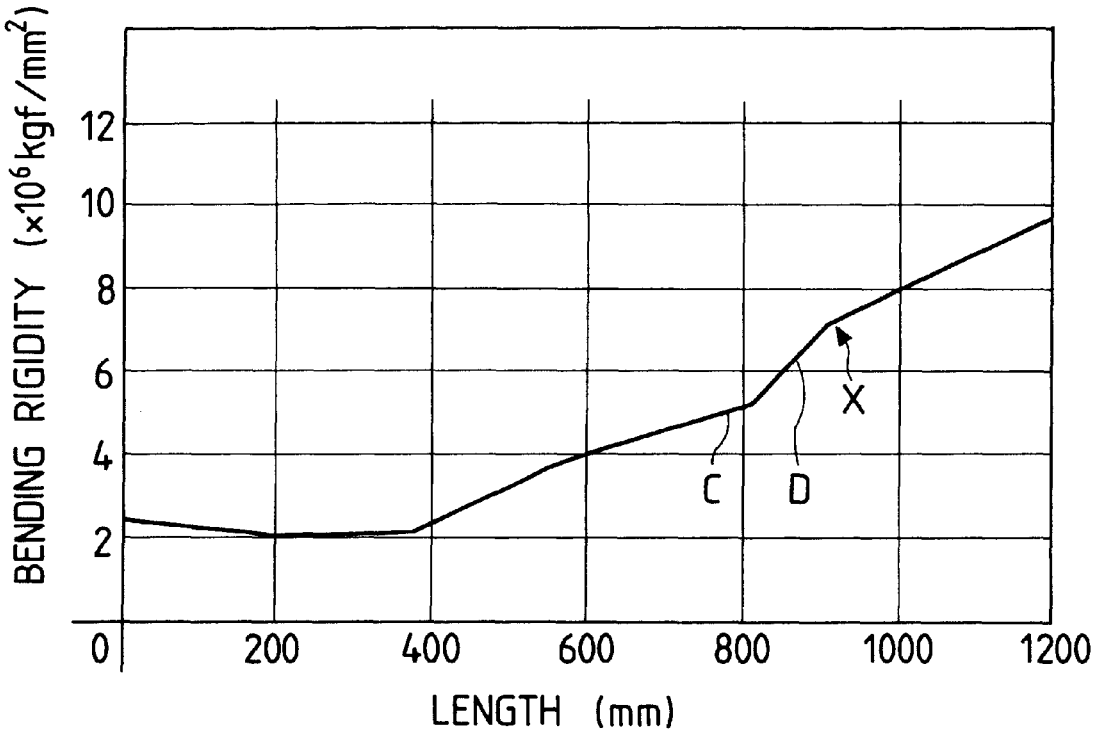
FIG. 11 is a characteristic diagram illustrating the relationship between length L and bending rigidity in the golf club shaft according to the present invention.

The golf club shaft according to the present invention manufactured thus has a portion X conspicuously improved in bending rigidity as shown in FIG. 11, and the rigidity is however much smaller than conventional one. As for the torsional rigidity, unlike the bending rigidity, not a rigidity difference in accordance with an outer diameter difference but the torsional rigidity of the small-diameter portion should be taken into consideration. Accordingly, the rigidity difference in accordance with the outer diameter difference is allowed even if it is larger than the case of the bending rigidity.

The bending rigidity in the rear end portion (C) of the small-diameter portion 51*a* is within a range of from 60% to 100% of the bending rigidity in the front end portion (D) of the large-diameter portion 51*b*. That is, in FIG. 11, the bending rigidity in the rear end portion (C) of the small-diameter portion 51*a* is about $5\times10^6$ kg*mm$^2$, which is about 80% of the bending rigidity of about $6.2\times10^6$ kg*mm$^2$ in the front end portion (D) of the large-diameter portion 51*b*.

In the golf club using the golf club shaft according to the present invention, most of the shaft is constituted by the small-diameter portion, so that air resistance in swinging the shaft is reduced, and the shaft can be swung out sharply. In addition, the balance in rigidity (bending and torsional) is good, so that the strength is large, and the balance in strength is superior. In addition, since most of the shaft is constituted by the small-diameter portion, the appearance of the shaft is also excellent.

The present invention is not limited to the above-mentioned embodiment, and can be carried out through various modifications.

As has been described above, in a golf club shaft according to the present invention, most area of the shaft except a grip portion and its neighborhood is made small in diameter, so that it is possible to reduce air resistance in swinging the shaft, and hence it is easy to swing out the shaft.

In addition, the golf club shaft according to the present invention has a shape in which the positions and rigidities of a small-diameter portion, a tapered portion and a large-diameter portion have been taken into consideration, so that the shaft is superior in strength and balance.

Further, in the golf club shaft according to the present invention, the grip portion is made large in diameter, so that it is easy to be gripped at the grip portion, and hence the feeling of stability at the time of gripping the shaft is improved.

Figure 12:
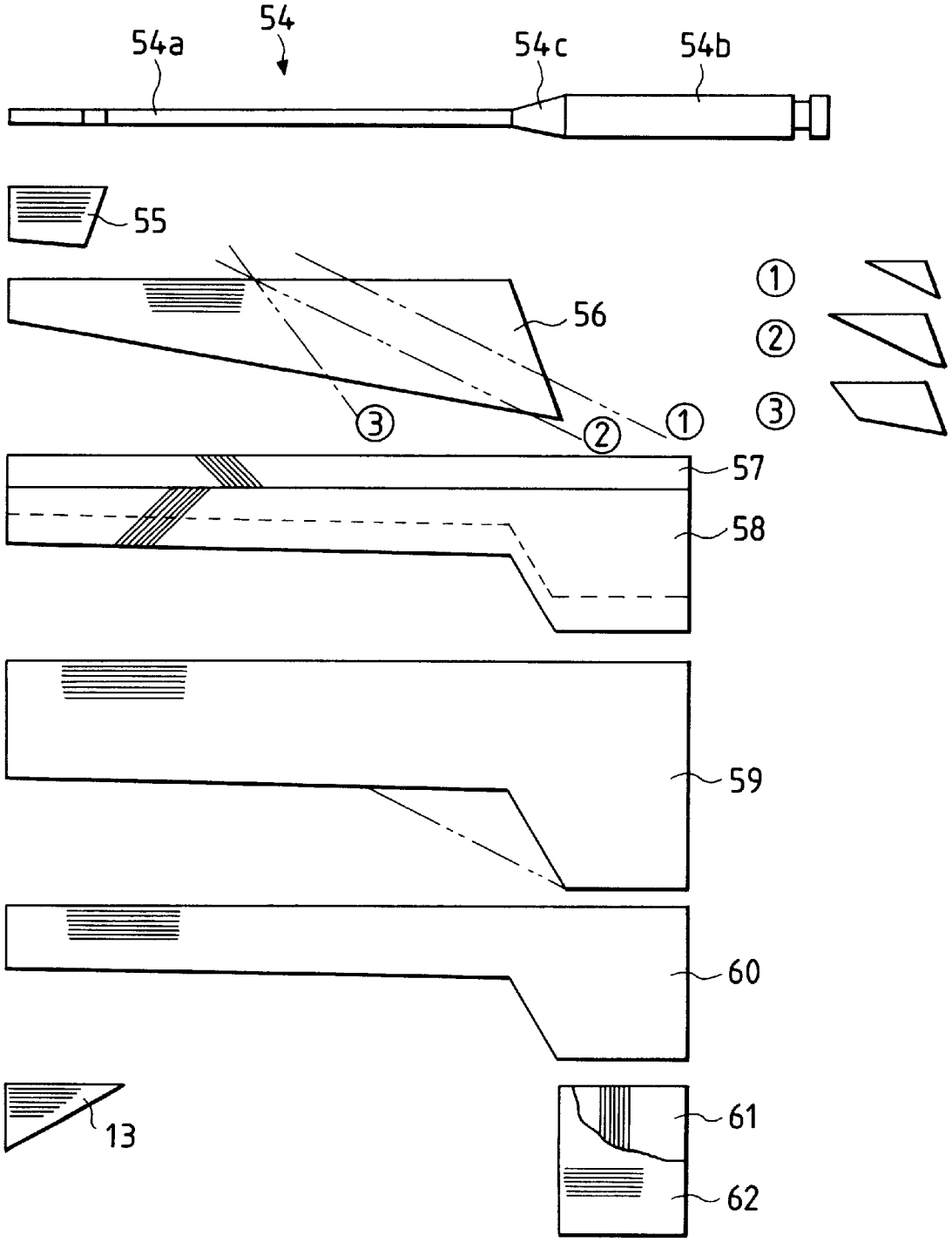
FIG. 12 is a diagram for explaining a process of manufacturing the golf club shaft according to the present invention.

In addition, it is preferable to increase thickness of a portion in front of a tapered portion of the shaft body. To this end, as shown in FIG. 12, a prepreg cut into a triangle shape (1), a prepreg cut into a substantially trapezoid shape (2), a prepreg cut into a substantially parallelogram shape or a prepreg of other shape is wound around a portion in front of the portion 54*c* of the mandrel 54 in place of or in addition to the prepreg 56 to increase the thickness. Further, it is also applicable to form one or more of the prepregs 57 to 60 to have a shape illustrated by two-dotted chain line in FIG. 12 (only one example is shown for the prepreg 59) in order to make a portion in front of the tapered portion thick.

What is claimed is:

1. A golf club shaft using a tube body made by winding fiber-reinforced prepeg formed from reinforcing fibers impregnated with synthetic resin, wherein said tube body has a front end portion to which a club head is to be attached, a grip portion provided opposite to said front end portion, and a torsional rigidity sudden-change portion provided between said front end portion and said grip portion, wherein torsional rigidity on a front end portion side in said torsional rigidity sudden-change portion is in a range of from 1 to 4 when torsional rigidity in said front end portion is assumed to be 1, wherein the torsional rigidity in said grip portion is at least $2500\times10^3$ kg*mm$^2$, and the torsional rigidity at said front end portion side of said sudden change portion is no larger than $1{,}500\times10^3$ KG*mm$^2$, and said front end side of said sudden change portion is located at a position at least ⅔ a length of said golf club from the front end portion, and wherein the rate of change in torsional rigidity relative to length in said torsional rigidity sudden change portion is larger than that in any other portion.

2. The golf club shaft according to claim 1, wherein the torsional rigidity in said front end portion increases along the length of said front end portion from a club head side to a sudden-change portion side, and wherein the torsional rigidity in said sudden-change portion increases along the length of the said sudden-change portion from said front end portion side to a grip portion side, and wherein a maximum torsional rigidity along the length of the golf club shaft is ing said grip portion.

3. The golf club shaft according to claim 2, wherein the ratio of a rate of change in torsionla rigidity along the length of the club shaft between the said club head side of said front end portion to said sudden-change portion side of said front end portion to the front end portion said sudden-change portion said grip portion side of said sudden-change portion is greater than 1:1.5.

4. The golf club shaft according to claim 2, wherein the ration of a rate of change in torsional rigidity along the length of the club shaft between the said club head side of said front end portion to said sudden-change portion side of said front end portion to the front end portion side of said sudden-change portion to said grip portion side of said sudden change portion portion is greater than 1:2.

5. A golf club shaft using a tube body made by winding fiber-reinforced prepeg formed from reinforcing fibers impregnated with synthetic resin, said tube body comprising: a front end portion connected to an intermediate portion which is in turn connected to a torsional rigidity sudden change portion which is in turn connected to a grip portion to form said tube body, wherein a front end of said front end portion has a torsional rigidity of about $700\times10^3$ kg*mm$^2$, said the torsional rigidity of said tube body proximate a connection of said intermediate portion and said torsional rigidity sudden change portion is about $1400\times10^3$ kg*mm$^2$, a torsional rigidity at a rear end of said grip portion is about $3{,}600\times10^3$ kg*mm$^2$ said tube body is about 1,200 mm long and said front end portion is at least 250 mm long, said grip portion is at least 300 mm long and said intermediate portion is at least 500 mm long, and a diameter of said tube body which tapers only in a direction from a grip end to said front end.

6. The golf club according to claim 5, wherein a ratio of a rate of change in torsional rigidity of said intermediate section is to a rate of change in torsional rigidity of said torsional rigidity sudden change portion is at least 1/1.5.

7. The golf club according to claim 5, wherein said ratio is at least 1/2.

* * * * *